US005815056A

United States Patent [19]

Tada et al.

[11] Patent Number: 5,815,056

[45] Date of Patent: Sep. 29, 1998

[54] DIELECTRIC RESONATOR HAVING AN ELONGATED NON-CONDUCTIVE RESONATOR GAPS AND MANUFACTURING METHOD THEREOF

[75] Inventors: Hitoshi Tada; Hideyuki Kato; Haruo Matsumoto; Tatsuya Tsujiguchi, all of Ishikawa, Japan

[73] Assignee: Murata Manufacturing Co., Ltd., Japan

[21] Appl. No.: 358,348

[22] Filed: Dec. 19, 1994

[30] Foreign Application Priority Data

Dec. 21, 1993 [JP] Japan ..... 5-322175

[51] Int. Cl.[6] ..... H01P 1/205

[52] U.S. Cl. ..... 333/202; 333/206; 333/207; 333/222; 333/223

[58] Field of Search ..... 333/202, 206, 333/207, 222, 223, 202 DB

[56] References Cited

U.S. PATENT DOCUMENTS

| | | | |
|---|---|---|---|
| 4,800,348 | 1/1989 | Rosar et al. | 333/202 |
| 5,162,760 | 11/1992 | Phillips et al. | 333/206 |
| 5,175,520 | 12/1992 | Inoue | 333/222 |
| 5,406,236 | 4/1995 | Newell et al. | 333/206 |

FOREIGN PATENT DOCUMENTS

| | | | |
|---|---|---|---|
| 0538894A1 | 4/1993 | European Pat. Off. . | |
| 58-051601 | 3/1983 | Japan . | |
| 245602 | 10/1986 | Japan | 333/222 |
| 104201 | 5/1987 | Japan | 333/202 DB |
| 01103001 | 4/1989 | Japan . | |
| 249801 | 11/1991 | Japan | 333/206 |
| 5145301 | 6/1993 | Japan | 333/223 |
| 5-199013 | 8/1993 | Japan . | |
| 5335808 | 12/1993 | Japan | 333/206 |
| 5343903 | 12/1993 | Japan | 333/206 |

OTHER PUBLICATIONS

Patent Abstracts of Japan, vol. 12, No. 379 (E–667) (3226), Oct. 11, 1988; JP–A–63 127 605 (Toko Inc) May 31, 1988.

Patent Abstracts of Japan, vol. 12, No. 379 (E–667) (3226), Oct. 11, 1988; JP–A–63 127 606 (Toko Inc) May 31, 1988.

Patent Abstracts of Japan, vol. 17, No. 599 (E–1455), Nov. 2, 1993; JP–A–05 183 308 (Uniden Corp) Jul. 23, 1993.

Soviet Inventions Illustrated, Section EI, Week C45, Dec. 17, 1980, Derwent Publications, Ltd., London, GB; Class W02, AN K8456 C/45; SU–A–723 701 (Batalov) Mar. 28, 1980.

European Search Report dated Mar. 30, 1995.

*Primary Examiner*—Benny T. Lee

*Attorney, Agent, or Firm*—Ostrolenk, Faber, Gerb & Soffen, LLP

[57] ABSTRACT

In a dielectric resonator, through holes are formed between opposing two surfaces of a dielectric block, an outer conductor is provided on an outer peripheral surface of the dielectric block, and a plurality of inner conductors are formed on the inner surfaces of the through holes, isolated by non-conducting portions where the inner conductor is not provided. Near the open end of the inner conductor of the resonator hole, a non-conducting portion is formed by partially removing the inner conductor in the axial direction, at a position opposing to an adjacent through hole, or a position near the outer conductor, so as to increase odd mode or even mode characteristic impedance near the open end, whereby inductive coupling is adjustable.

35 Claims, 15 Drawing Sheets

DIELECTRIC RESONATOR HAVING AN ELONGATED NON-CONDUCTIVE RESONATOR GAPS AND MANUFACTURING METHOD THEREOF

BACKGROUND OF THE INVENTION

1. Field of the Invention

The present invention relates to a dielectric resonator and manufacturing method thereof. More specifically, the present invention relates to a dielectric resonator in which a plurality of inner conductors are provided in the dielectric body and an outer conductor is provided on an outer peripheral surface of the dielectric body, and to the manufacturing method thereof.

2. Description of the Background Art

Conventionally, a dielectric resonator in which a plurality of resonators are formed in a rectangular parallelepiped dielectric block and which is used as a bandpass filter, for example, consisting of plural stages of resonators has been used. The applicant of the present invention has proposed such a dielectric resonator in Japanese Patent Laying-Open No. 5-199013. FIGS. 25 and 26 show an example of such a dielectric resonator, in which FIG. 25 is a perspective view of the dielectric resonator and FIG. 26 is a vertical section taken along the line Y—Y of FIG. 25.

Referring to FIGS. 25 and 26, a dielectric block 1 includes a first surface S1 and a second surface S2 opposing to each other. Four through holes 2*a,* 2*b,* 2*c* and 2*d* piercing through the first and second surfaces S1 and S2 are formed in dielectric block 1. In respective through holes, inner conductors 3*a,* 4*a,* 3*b,* 4*b,* 3*c,* 4*c,* 3*d* and 4*d* are formed separated from each other by non-conducting portions 5*a,* 5*b,* 5*c* and 5*d,* respectively, as shown in FIG. 26. At the non-conducting portions 5*a* to 5*d,* the surface of the dielectric block material is exposed in the shape of a ring. The example shown in FIG. 26 is a bandpass filter including four stages, in which stray capacitance is generated at non-conducting portions 5*a* to 5*d* where the inner conductor is not provided, the inner conductors 3*a* to 3*d* function as resonance conductors having the second surface S2 as the short-circuited surface and the first surface S1 as the stray surface, and adjacent resonance conductors are coupled to a common line. However, in the dielectric resonator described above, the axial length L of the inner conductors 3*a* to 3*d* serving as the resonance conductors is determined dependent on the position of the non-conducting portion, and the stray capacitance at the edge of the resonance conductor is determined by the width B of the non-conducting portions 5*a* to 5*d,* as shown in FIG. 26. Therefore, when the axial length of the resonance conductor is to be shortened, the width of the non-conducting portions 5*a* to 5*d* changes together with the axial length of the resonance conductor. As a result, both the resonance frequency and the coupling strength between adjacent resonators change simultaneously, making it difficult to obtain desired characteristics.

Therefore, an object of the present invention is to provide a dielectric resonator which allows setting or adjustment of resonance frequency of the resonator of each stage, as well as setting or adjustment of coupling strength between resonators at a desired value, and to provide a manufacturing method thereof.

Another object of the present invention is to provide a dielectric resonator in which a resonance frequency of the resonator can be set or adjusted independent from the coupling strength between resonators, and to provide a manufacturing method thereof.

Still another object of the present invention is to provide a dielectric resonator in which a resonance frequency can be adjusted in either a direction increasing coupling strength of adjacent resonators or a direction for decreasing the coupling strength, and to provide a manufacturing method thereof.

A still further object of the present invention is to provide a dielectric resonator in which coupling strength between adjacent resonators can be changed by a relatively large amount, and to provide the manufacturing method thereof.

Briefly stated, in the present invention, a plurality of resonator holes are formed to pierce through at least one end surface of a dielectric block, an inner conductor is formed at the inner peripheral surface of each resonator hole, one end of the inner conductor is open-circuited, the other end is connected to an outer conductor so as to serve as a short-circuited end, and a non-conducting portion, at which the inner conductor is removed, is formed near the open-circuited end of any of the plurality of inner conductors, such that the non-conducting portion extend to a prescribed length in the axial direction of the resonator hole.

Therefore, according to the present invention, the substantial length of the resonator which corresponds to the length of the inner conductor serving as the resonance conductor is made shorter than when the non-conducting portion with the inner conductor removed is not formed, so that the resonance frequency is slightly increased. In addition, electrostatic capacitance between the non-conducting portion provided by removing the conductor and an end (i.e., the open-circuited end) of the inner conductor serving as the resonance conductor provided at an adjacent resonator hole is reduced, so that a characteristic impedance near the end of the inner conductor is increased, and the inductive coupling can be changed.

More preferably, the non-conducting portion where the inner conductor is removed, is provided at a position opposing to an adjacent resonator hole. Therefore, according to this embodiment, the odd mode characteristic impedance near the end of the inner conductor serving as the resonance conductor is increased, thus enhancing inductive coupling. In another preferred embodiment of the present invention, the non-conducting portion with the conductor removed is formed at a position near the outer conductor. Therefore, according to this embodiment, an even mode characteristic impedance near the end of the inner conductor serving as the resonance conductor is increased, thus reducing inductive coupling.

In a still another preferred embodiment, non-conducting portions with the conductor removed are formed at a position opposing to an adjacent resonator hole and at a position near the outer conductor, respectively. Therefore, in this embodiment, both an odd mode characteristic impedance and an even mode characteristic impedance near the end of the inner conductor serving as the resonance conductor are determined, and the coupling strength between adjacent resonators is determined in accordance with both characteristic impedances.

Further, in another more preferred embodiment of the present invention, the non-conducting portion with the conductor removed is formed at an intermediate position between the position opposing to the adjacent resonator and the position adjacent to the outer conductor. Therefore, in this embodiment, both the even mode and odd mode characteristic impedances are determined, and coupling strength between the resonators can be determined. Therefore, by determining the position where the non-conducting portion with the conductor removed is to be formed intermediate between the position opposing to the adjacent resonator and the position near the outer conductor, both the resonance frequency and coupling strength can be set (i.e., finely adjusted).

According to another aspect, the present invention provides a method of manufacturing a dielectric resonator including the steps of forming a plurality of resonator holes each having an inner conductor therein, in a dielectric block having a pair of opposing end surfaces, forming an outer conductor at an outer peripheral surface of the dielectric block, removing the inner conductor at a portion near an open end of any of the plurality of inner conductors such that the portion from which the inner conductor is removed extends by a prescribed length in the axial direction of the resonator hole, so as to allow fine adjustment of the resonance frequency.

The foregoing and other objects, features, aspects and advantages of the present invention will become more apparent from the following detailed description of embodiments of the present invention when taken in conjunction with the accompanying drawings in which like reference numerals correspond to like elements and parts.

DESCRIPTION OF THE PREFERRED EMBODIMENTS

Figure 1:
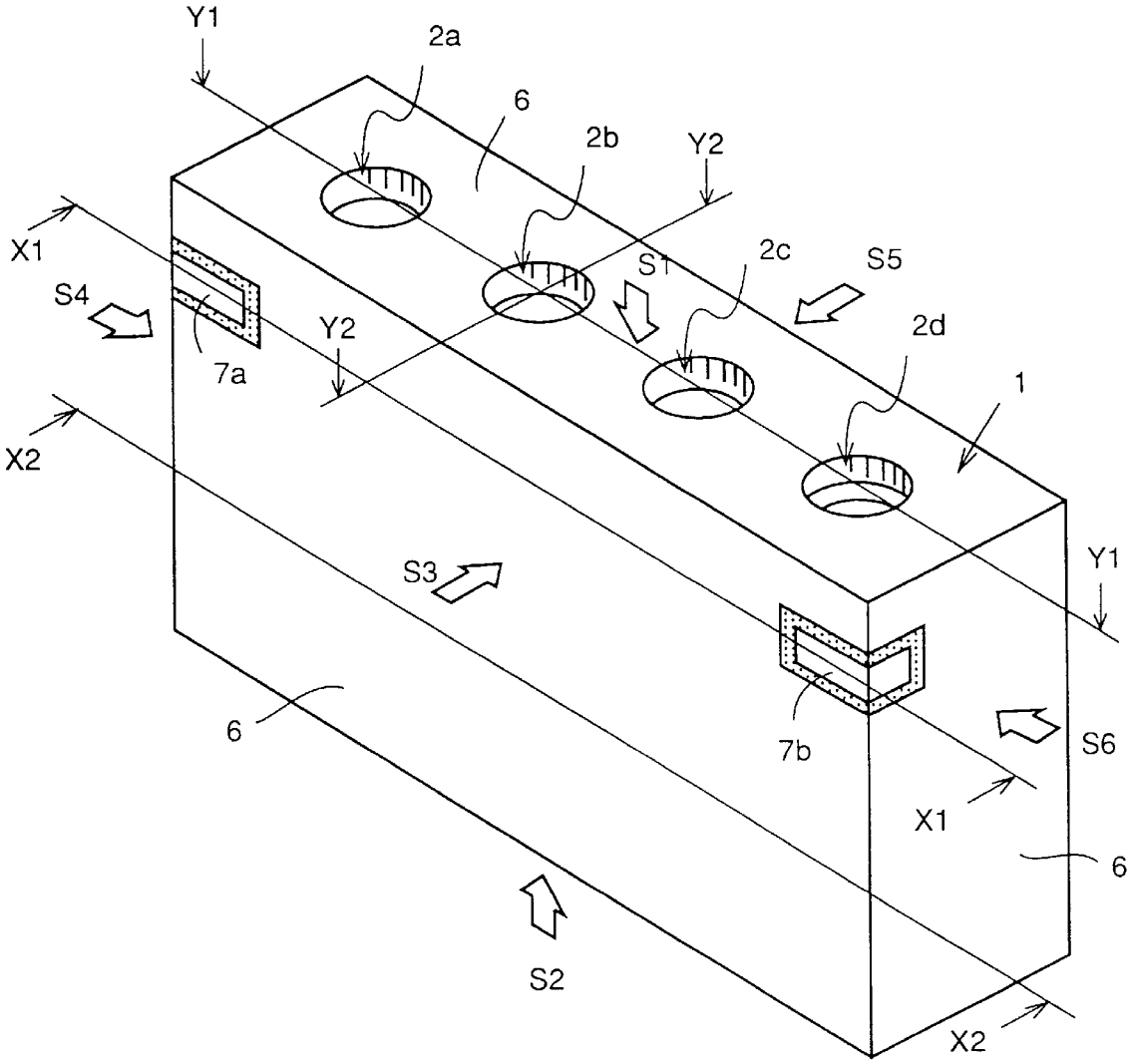
FIG. 1 is a perspective view of a dielectric resonator in accordance with a first embodiment of the present invention.
Figure 2:
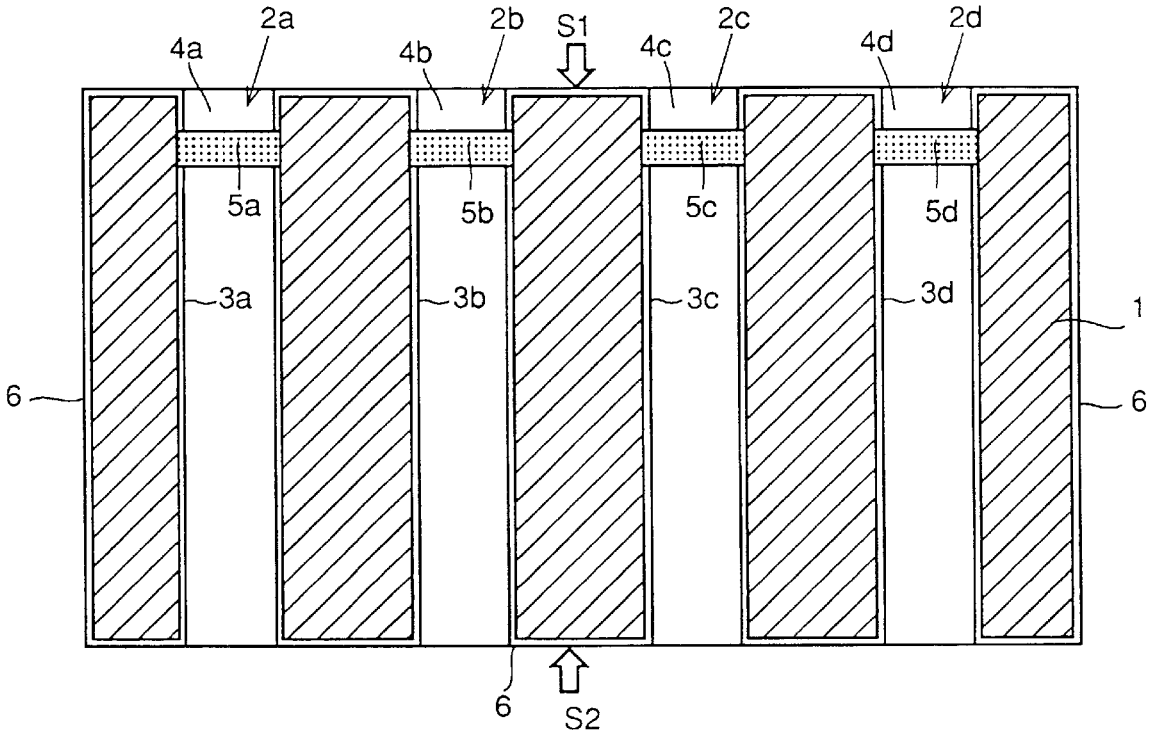
FIG. 2 is a vertical section taken along the line Y1—Y1 of FIG. 1, before fine adjustment.
Figure 3:
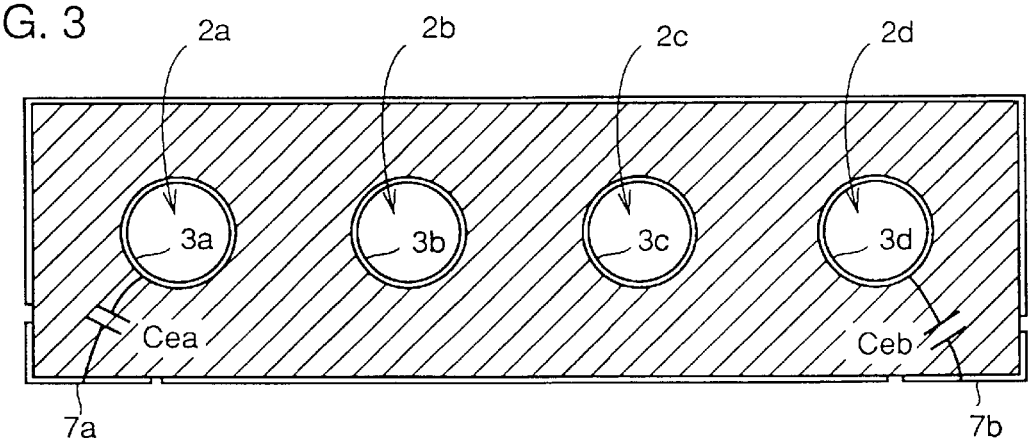
FIG. 3 is a cross section taken along the line X1—X1 of FIG. 1 before fine adjustment.

FIGS. 1 to 3 show a dielectric resonator in accordance with the first embodiment of the present invention, in which FIG. 1 is a perspective view, FIG. 2 is a vertical section taken along the line Y1—Y1 of FIG. 1 before fine adjustment and FIG. 3 is a cross section taken along the line X1—X1 of FIG. 1 before fine adjustment.

Referring to FIG. 1, dielectric block 1 is approximately a rectangular parallelepiped. Four through holes 2*a*, 2*b*, 2*c* and 2*d* piercing through opposing first surface S1 and second surface S2 are formed in dielectric block 1. An outer conductor 6 is formed on the first surface S1, the second surface S2 and each of four side surfaces S3, S4, S5 and S6 of dielectric block 1. A signal input/output conductor 7*a* is provided bridging side surfaces S3 and S4, and signal input/output conductor 7*b* is provided bridging side surfaces S3 and S6, each insulated from the outer conductor 6.

Further, referring to FIG. 2, a plurality of inner conductors 3*a*, 4*a*, 3*b*, 4*b*, 3*c*, 4*c*, 3*d* and 4*d* are formed on the inner surfaces of through holes 2*a*, 2*b*, 2*c* and 2*d*, separated by first non-conducting portions 5*a*, 5*b*, 5*c* and 5*d*, respectively. At the first non-conducting portions 5*a* to 5*d*, the surface of the dielectric block material is exposed in a ring-shape. In the example shown in FIG. 2, stray capacitance is generated at the first non-conducting portions 5*a* to 5*d* where the inner conductor is not provided, and each of the inner conductors 3*a* to 3*d* functions as a resonance conductor having the wavelength of $\lambda/4$ having the second surface S2 as the short-circuited surface and the first surface S1 as the stray surface. Referring to FIG. 3, the electrostatic capacitance between inner conductor 3*a* and signal input/output conductor 7*a* and between the inner conductor 3*d* and the signal input/output conductor 7*b* are utilized as external coupling capacitances Cea and Ceb, respectively.

Figure 4:
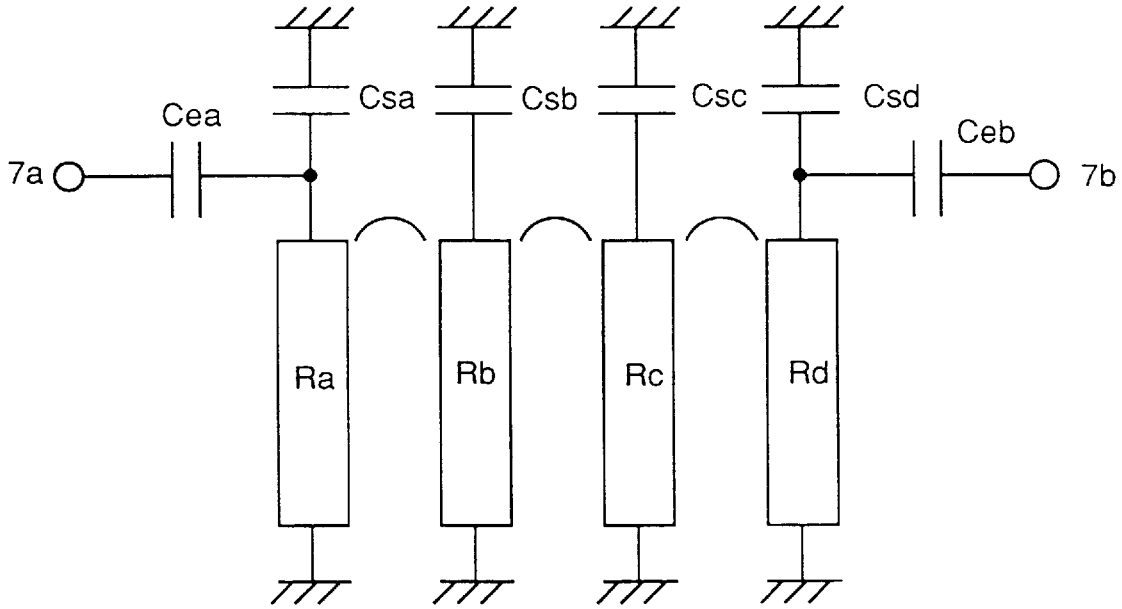
FIG. 4 is an equivalent circuit diagram of the dielectric resonator shown in FIG. 1.

FIG. 4 is an equivalent circuit diagram of the dielectric resonator having the structure shown in FIGS. 1 to 3. Referring to FIG. 4, resonators Ra, Rb, Rc and Rd are formed at through holes 2*a,* 2*b,* 2*c* and 2*d* shown in FIG. 2, stray capacitances Csa, Csb, Csc and Csd are formed at the first non-conducting portions 5*a,* 5*b,* 5*c* and 5*d* shown in FIG. 2; and external coupling capacitances Cea and Ceb are formed between inner conductor 3*a* and signal input/output conductor 7*a* and between inner conductor 3*d* and signal input/output conductor 7*b.* In this manner, a bandpass filter having four stages coupled as a comb line is provided.

Now, a method of manufacturing the dielectric resonator in accordance with the first embodiment of the present invention will be described. The first non-conducting portions 5*a* to 5*d* shown in FIG. 2 are formed in the following manner. A rotary grinder is inserted in each of the through holes 2*a* to 2*d* from the first surface S1 of dielectric block 1. While rotating the rotary grinder, the center of rotation of the grinder is revolved in the circumferential direction of the through hole (i.e., with so-called planetary movement), whereby the inner conductor and part of the dielectric body are partially removed. Thus, the first non-conductive portions are formed. By moving the rotary grinder in the axial direction of the through hole while continuing the planetary movement, the width of the first non-conducting portion can be increased. The width and position of formation in the through hole of the first non-conducting portion is predetermined in accordance with the resonance frequency of the resonator of each stage and the required stray capacitance. Then, in the step of rough adjustment, the dielectric resonator is connected to a network analyzer, and the width of the first non-conducting portion of each stage is widened toward the inner conductors 3*a* to 3*d* serving as the resonance conductor or toward the inner conductors 4*a* to 4*d* extending from the outer conductor while measuring the filtering characteristics, whereby the resonance frequency of the resonator of each stage and the coupling strength between the resonators are roughly adjusted.

Now the method of subsequent fine adjustment will be described.

Figure 5:
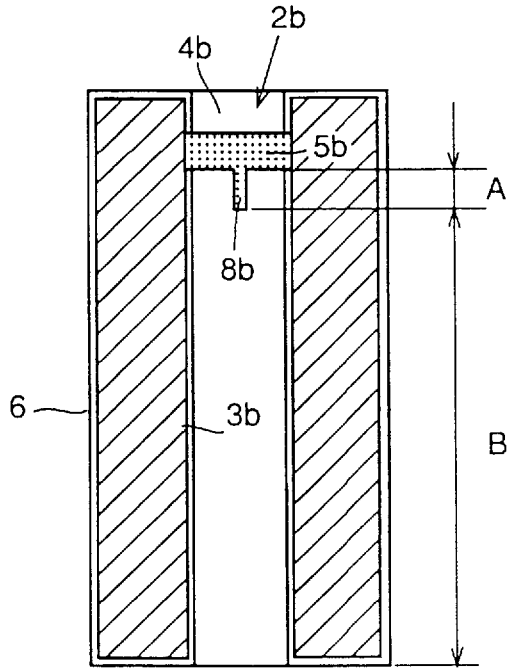
FIG. 5 is a vertical section taken along the line Y2—Y2 of FIG. 1 after fine adjustment.

FIG. 5 is a vertical section taken along the line Y2—Y2 of FIG. 1 after fine adjustment of the dielectric resonator shown in FIGS. 1 to 3. Referring to FIG. 5, inner conductors 3*b* and 4*b* are formed separated by the first non-conducting portion 5*b* on the inner surface of through hole 2*b.* In the step of fine adjustment, the inner conductor is partially removed along the axial direction of the through hole 2*b,* extending continuously from the first non-conducting portion 5*b* in the direction toward the inner conductor 3*b* serving as the resonance conductor, at a position opposing to an adjustment through hole 2*a.* Thus a second non-conducting portion 8*b* is formed. The second non-conducting portion 8*b* is formed by moving the rotary grinder from the first non-conducting portion 5*b* along the axial direction of the through hole 2*b* so as to remove the inner conductor. Thus substantial axial length of the inner conductor 3*b* serving as the resonance conductor is shortened, the electrostatic capacitance between the portion near the end of inner conductor 3*b* and the portion near the end of inner conductor 3*a* is reduced, the odd mode characteristic impedance near the end portion is increased, and inductive coupling become stronger. The dielectric resonator having the second non-conducting portion may be regarded as a resonator having a stepped coupling structure in which the impedance at the portion A including the second non-conducting portion is different from the impedance of remaining portion B.

Figure 6:
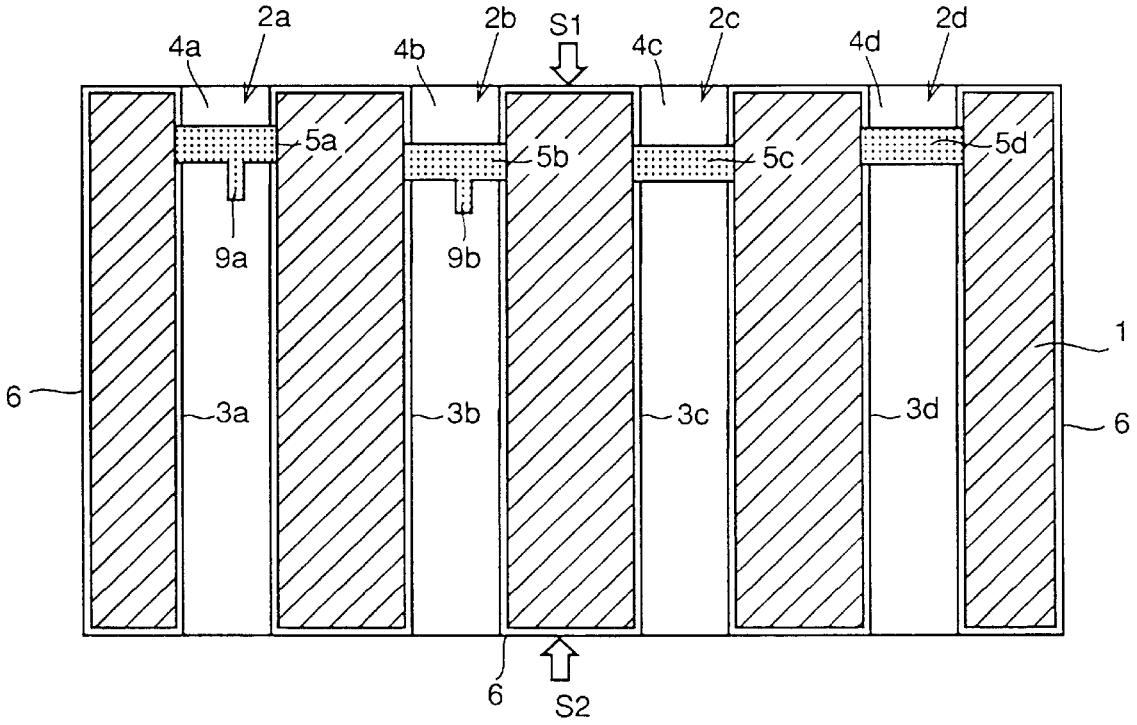
FIG. 6 is a vertical section taken along the line Y1—Y1 of FIG. 1 after fine adjustment.

FIG. 6 shows another view in which a second non-conducting portion is formed at a position different from that shown in FIG. 5, and it is a vertical section taken along the line Y1—Y1 of FIG. 1 of the dielectric resonator shown in FIGS. 1 to 3, after fine adjustment. In the view shown in FIG. 5, the second non-conducting portion 8*b* was formed at a position opposing to the adjacent through hole 2*a.* However, in FIG. 6, the second non-conducting portion 9*a* is formed by removing inner conductor 3*a* along the axial direction of the through hole 2*a,* extending continuously from the first non-conducting portion 5*a,* at a position adjacent to the outer conductor formed on the side surface S5 of FIG. 1. Consequently, the substantial axial length of inner conductor 3*a* as the resonance conductor is made shorter, the electrostatic capacitance between the outer conductor and the portion near the end of inner conductor 3*a* is reduced, the even mode characteristic impedance near the end of inner conductor 3*a* is increased, and thus the inductive coupling between the resonators becomes weaker. In the example shown in FIG. 6, a second non-conducting portion 9*b* is also formed near the end of inner conductor 3*b* of through hole 2*b.*

Figure 7A:
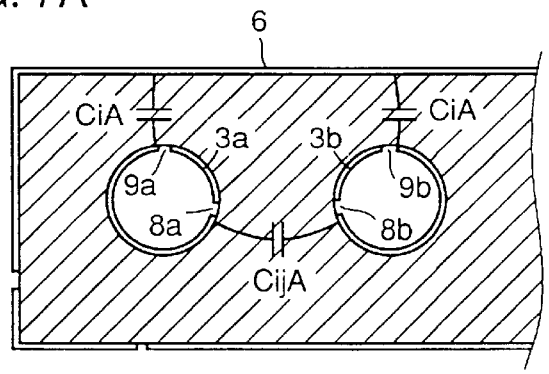
FIG. 7A is a partial cross section taken along the line X1—X1 of FIG. 1 after fine adjustment.
Figure 7B:
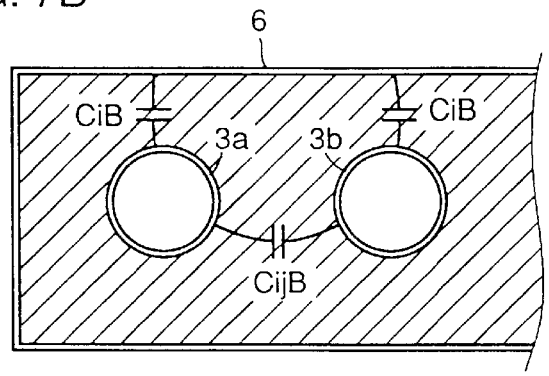
FIG. 7B is a partial cross section taken along the line X2—X2 of FIG. 1 after fine adjustment.

FIGS. 7A and 7B are partial cross sections taken along the lines X1—X1 and X2—X2 of FIG. 1 after fine adjustment, respectively, and corresponding to FIGS. 5 and 6. Referring to FIGS. 7A and 7B, electrostatic capacitance Cij is formed between end portions of inner conductors 3*a* and 3*b,* and electrostatic capacitance Ci is formed between portions near inner conductors 3*a* and 3*b* and outer conductor 6, where an additional suffix A represents the portion at which the second non-conducting portion is formed, and the suffix B denotes the portion other than the second non-conducting portion. The even mode characteristic impedances and odd mode characteristic impedances $Ze_A$, $Ze_B$, $ZO_A$ and $ZO_B$ are represented by the following equations:

$$Ze_A = \sqrt{\epsilon r} \;/(Ci_A \cdot Vc)$$

$$Ze_B = \sqrt{\epsilon r)} \;/(Ci_B \cdot Vc)$$

$$Zo_A = \sqrt{\epsilon r} \;/\{(Ci_A = 2\,Cij_A) \cdot Vc\}$$

$$Zo_B = \sqrt{\epsilon r} \;/\{(Ci_B + 2\,Cij_B) \cdot Vc\}$$

where Vc represents the velocity of light.

Coupling between adjacent resonators are expressed by the following inequalities:

When $Ze_A/Ze_B < ZO_A/ZO_B$, coupling is inductive coupling.

When $Ze_A/Ze_B > ZO_A/ZO_B$, coupling is capacitive coupling.

In the above described embodiments, as best seen in FIG. 7A, both the second conducting portions 8*a* (and 8*b*) and 9*a* (and 9*b*) are formed. However, the second conducting portions may be formed only at the position opposing to the adjacent through hole or at the position near the outer conductor. For example, in order to increase the resonance frequency of the resonator provided by inner conductor 3*a,* the portion represented by 8*a* or 9*a* may be removed. When inductive coupling with the resonator provided by inner conductor 3*b* is to be increased, the portion represented by 8*a* may be removed. Or, if the coupling strength is to be reduced, the portion represented by 9*a* may be removed. In order to adjust resonance frequency while maintaining constant coupling strength, portions represented by 8*a* and 9*a* may be both removed.

Figure 8:
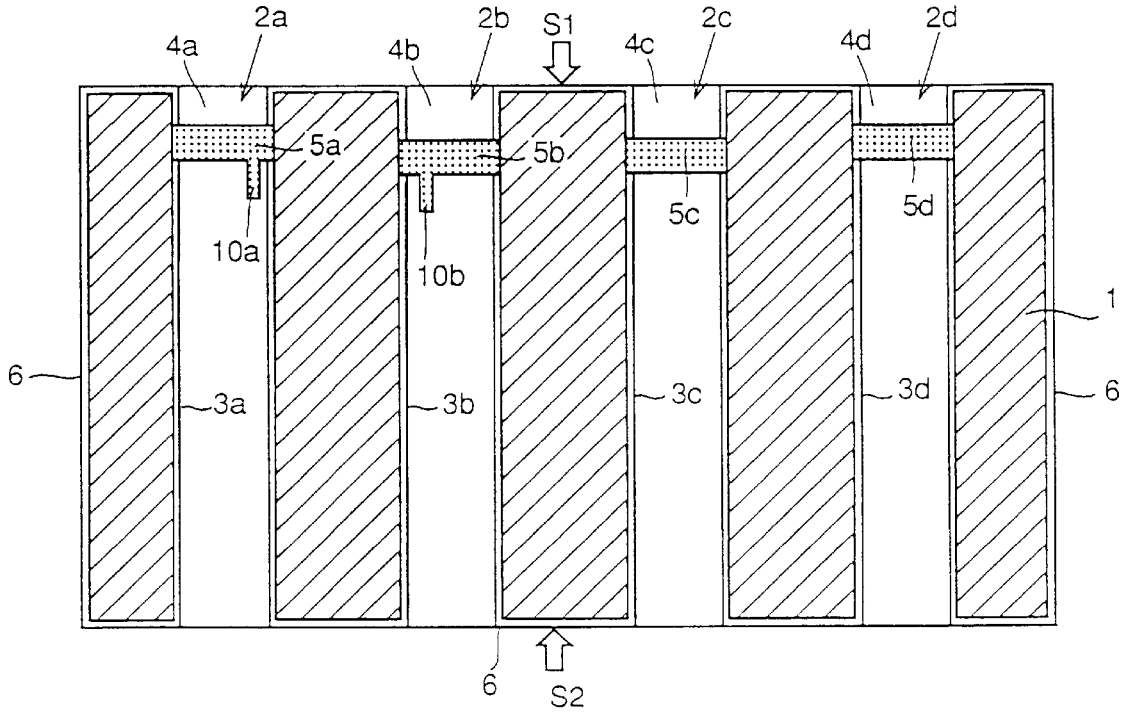
FIG. 8 is a vertical section taken along the line Y1—Y1 of FIG. 1 after fine adjustment, in accordance with a modification of the first embodiment of the present invention.
Figure 9:
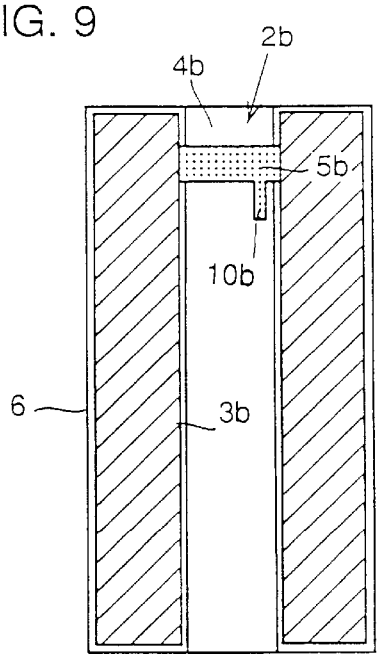
FIG. 9 is a vertical section taken along the line Y2—Y2 of FIG. 1 after fine adjustment in accordance with the modification of the first embodiment of the present invention.
Figure 10:
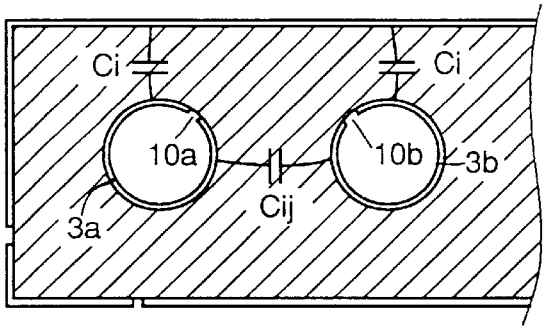
FIG. 10 is a partial cross section taken along the line X1—X1 of FIG. 1 after fine adjustment in accordance with the modification of the first embodiment of the present invention.

FIG. 8 is a vertical section taken along the line Y1—Y1 of FIG. 1 after fine adjustment, in accordance with a modification of the first embodiment of the present invention, FIG. 9 is a vertical section taken along the line Y2—Y2 of FIG. 1, and FIG. 10 is a partial cross-section taken along the line X1—X1 of FIG. 1.

In the example shown in FIGS. 5 to 7, the second non-conducting portion is formed either at a position opposing the adjacent through hole or a position near the outer conductor, or the second conducting portions are formed at both of these positions. In the example shown in FIGS. 8 and 9, the second non-conducting portion is formed at a position intermediate between the position opposing the adjacent through hole and the position adjacent to the outer conductor. Referring to FIGS. 8 and 9, the second non-conducting portions 10*a* and 10*b* are formed by removing the inner conductors along the axial direction of the through holes continuously from the first non-conducting portions 5*a* and 5*b*, each at approximately the central position between the position opposing the adjacent through hole and the position near the outer conductor, in the through holes 2*a* and 2*b*. In this case, the resonance frequency of the resonators provided by inner conductors 3*a* and 3*b* can be adjusted by changing the amount of removal at the second non-conducting portions 10*a* and 10*b*, and the coupling strength between the resonators can be adjusted by changing the position at which the second non-conducting portions are formed. Referring to FIG. 10, by providing the second non-conducting portions 10*a* and 10*b* at positions near to the position opposing to the adjacent through holes, the electrostatic capacitance Cij shown in FIG. 7 can be reduced, the odd mode characteristic impedance is increased and the coupling strength can be increased. Conversely, by providing the second non-conducting portions 10*a* and 10*b* nearer to the position adjacent to outer conductor, the electrostatic capacitance Ci is reduced, the even mode characteristic impedance is increased, and the coupling strength between the resonators can be reduced.

Figure 11:
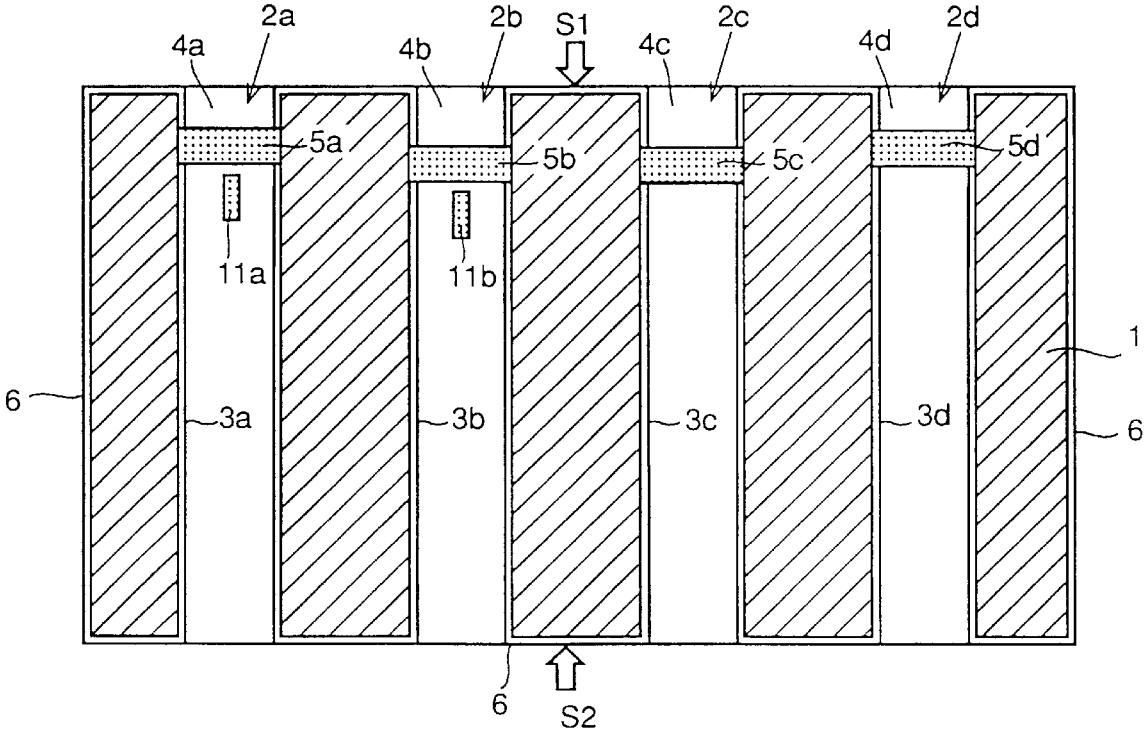
FIG. 11 is a vertical sectional view of a dielectric resonator in accordance with a second embodiment of the present invention.

FIG. 11 is a vertical section of the dielectric resonator in accordance with the second embodiment of the present invention. In the example shown in FIGS. 5 to 10 above, the second non-conducting portion is provided extending continuously from the first non-conducting portion. However, in the embodiment shown in FIG. 11, the second non-conducting portion is not continuous with the first non-conducting portion, but near and independent from the first non-conducting portion. FIG. 11 is a vertical section taken along the line Y1—Y1 of FIG. 1 after fine adjustment and in this example, the second non-conducting portions 11*a* and 11*b* are formed near the end portions of inner conductors 3*a* and 3*b*, near the first non-conducting portions 5*a* and 5*b*. In this example, the electrostatic capacitance between the portions near the ends of inner conductors 3*a* and 3*b* and outer conductor is reduced.

Figure 12:
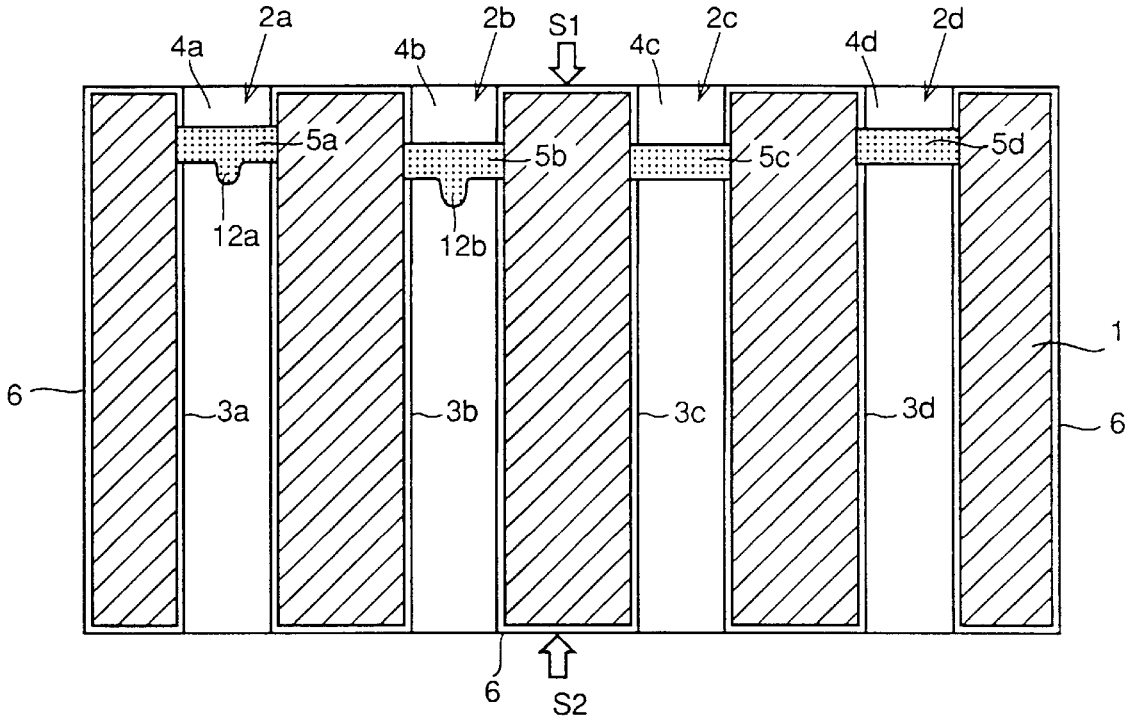
FIG. 12 is a vertical sectional view of a dielectric resonator in accordance with a third embodiment of the present invention.
Figure 13:
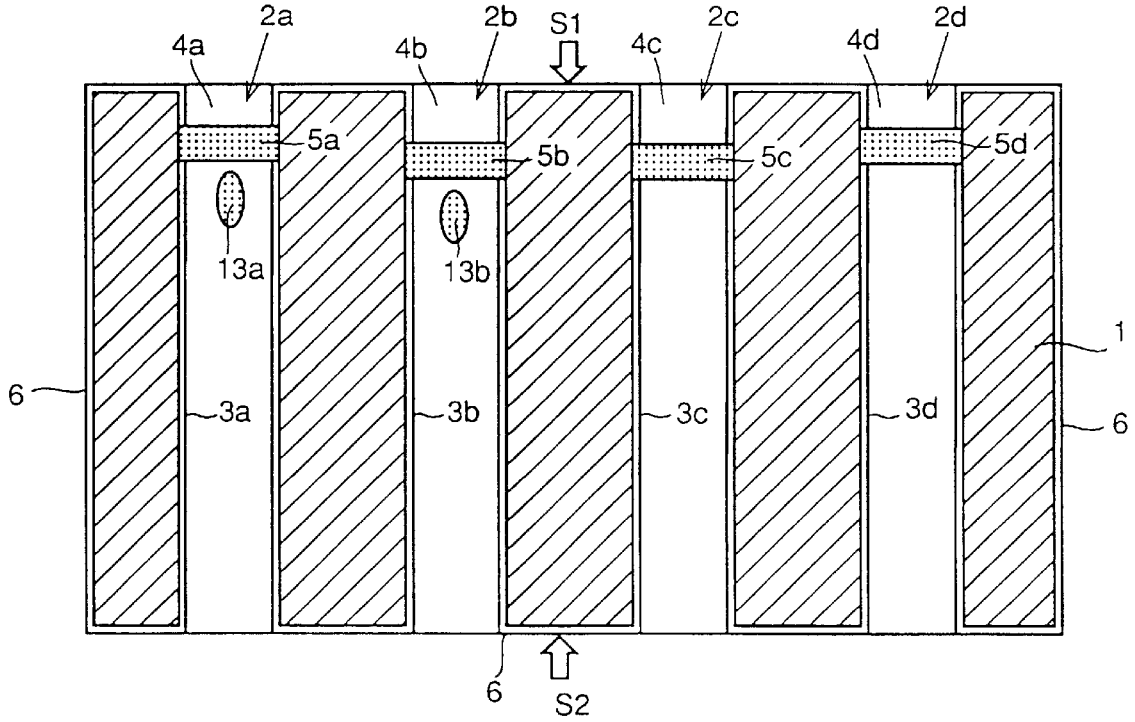
FIG. 13 is a vertical sectional view of a dielectric resonator in accordance with a fourth embodiment of the present invention.

FIG. 12 and 13 are vertical cross-sections of the dielectric resonator in accordance with the third and fourth embodiments of the present invention. In the embodiments above, the second non-conducting portion was formed to have a rectangular shape. However, the shape may be varied by changing the shape of the rotary grinder used for removing the inner conductor, or by changing the method of removal. For example, FIG. 12 shows second non-conducting portions 12*a* and 12*b* having a tapered shape. Elliptically shaped second non-conducting portions 13*a* and 13*b* are shown in the fourth embodiment of FIG. 13.

Figure 14:
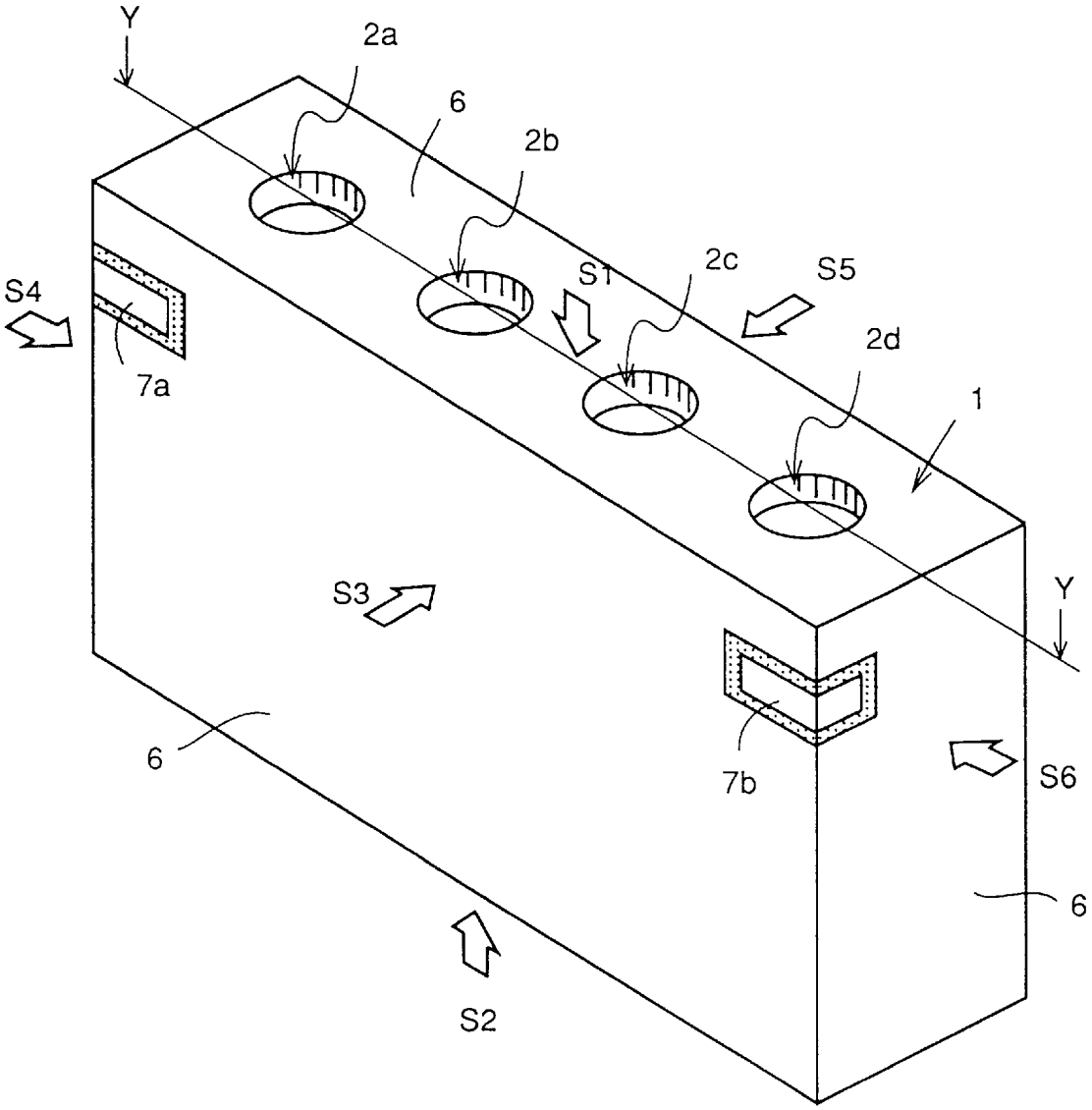
FIG. 14 is a perspective view of a dielectric resonator in accordance with a fifth embodiment of the present invention.
Figure 15:
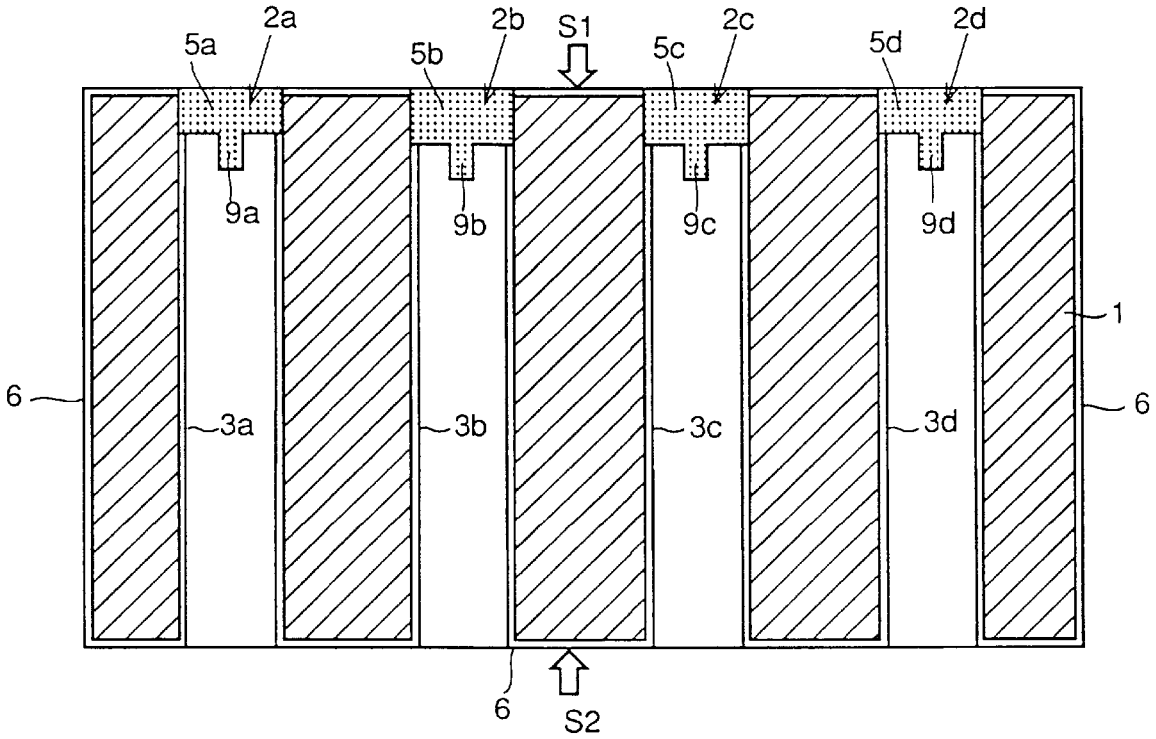
FIG. 15 is a vertical sectional view taken along the line Y—Y of FIG. 14.

FIG. 14 is a perspective view of the dielectric resonator in accordance with the fifth embodiment of the present invention and FIG. 15 is a vertical section taken along the line Y—Y of FIG. 14.

In the embodiment shown in FIG. 1, the first non-conducting portion is provided at a certain depth of the through hole. However, in the embodiment shown in FIGS. 14 and 15, the first non-conducting portion is formed at one opening of the through hole. By providing the first non-conducting portions 5*a* to 5*d* (see FIG. 15) at one opening of the through holes 2*a* to 2*d*, stray capacitance can be formed between the end portion of each of the inner conductors 3*a* to 3*d* and the outer conductor 6 formed at the first surface S1 of the dielectric body. In this example, the second non-conducting portions 9*a* to 9*d* (see FIG. 15) are formed at end portions of the inner conductors 3*a* to 3*d*, continuous with the first non-conducting portions 5*a* to 5*d*.

Figure 16:
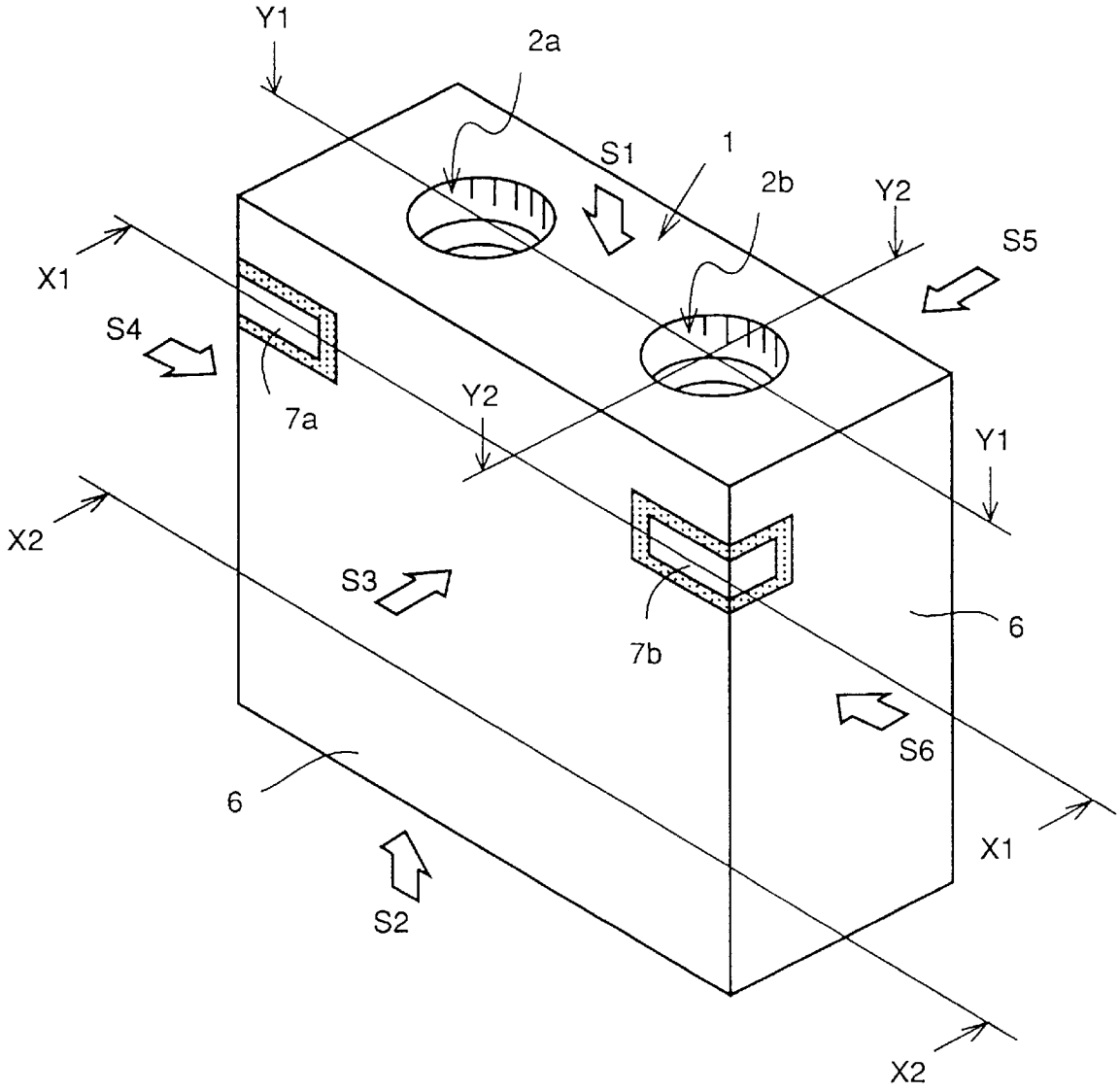
FIG. 16 is a perspective view of the dielectric resonator in accordance with a sixth embodiment of the present invention.
Figure 17:
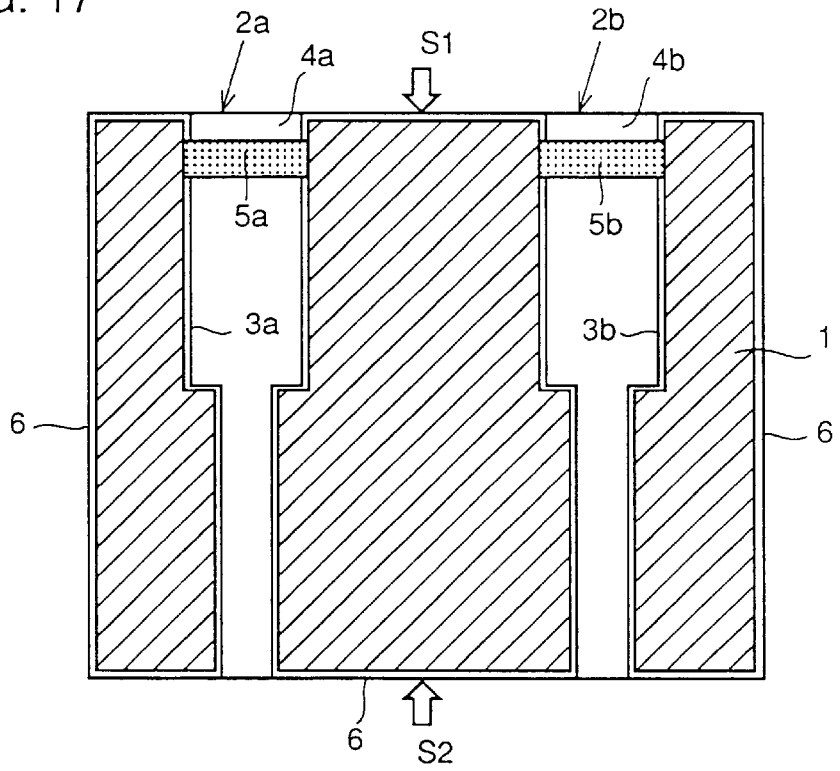
FIG. 17 is a vertical sectional view taken along the line Y1—Y1 of FIG. 16.
Figure 18:
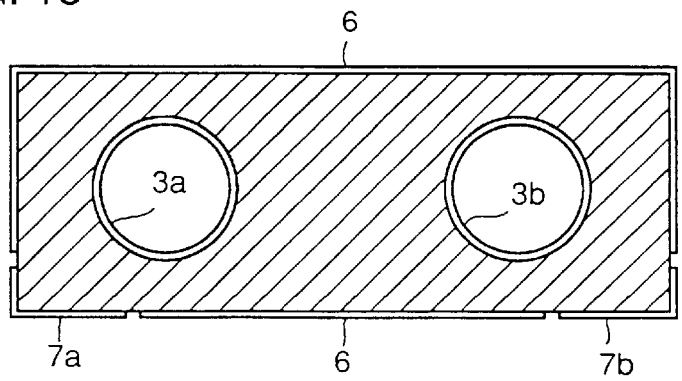
FIG. 18 is a cross section taken along the line X1—X1 of the dielectric resonator of FIG. 16 before fine adjustment.
Figure 19:
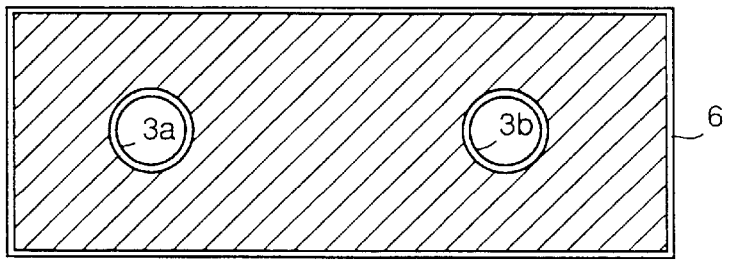
FIG. 19 is a cross section taken along the line X2—X2 of FIG. 16.
Figure 20:
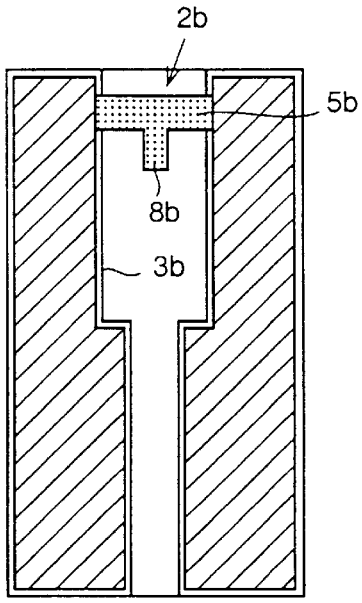
FIG. 20 is a vertical section taken along the line Y2—Y2 of the dielectric resonator shown in FIG. 16 after fine adjustment.
Figure 21:
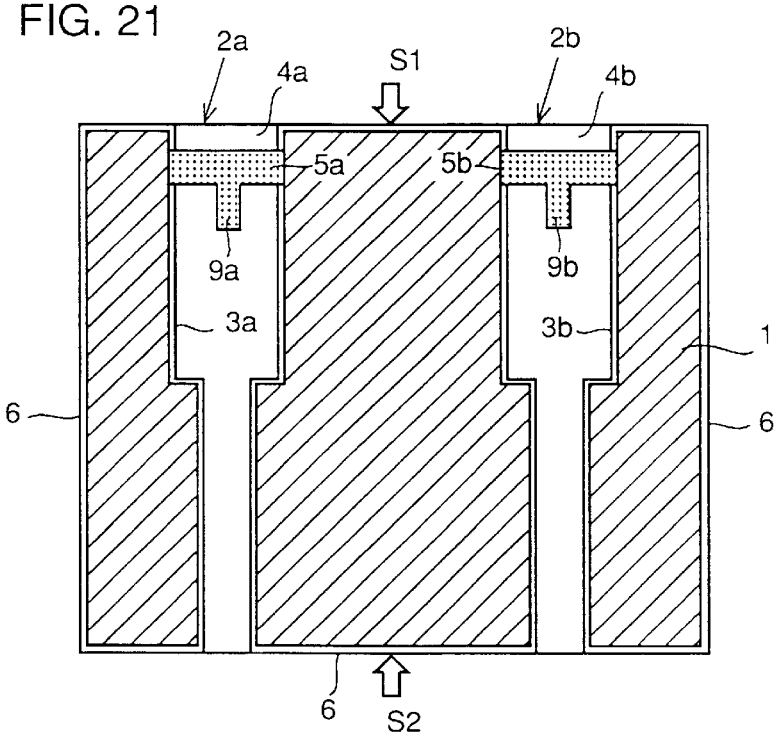
FIG. 21 is a vertical section taken along the line Y1—Y1 of the dielectric resonator of FIG. 16 after fine adjustment.
Figure 22:
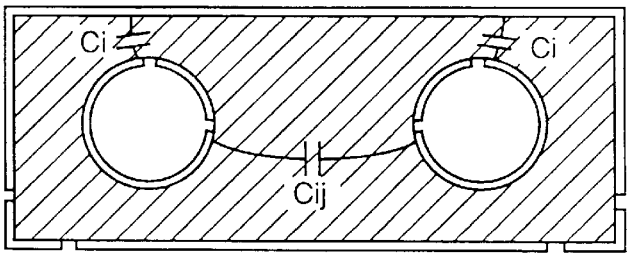
FIG. 22 is a cross section taken along the line X1—X1 of the dielectric resonator shown in FIG. 16 after fine adjustment.

FIGS. 16 to 22 show the sixth embodiment of the present invention showing an example in which the present invention is applied to a dielectric resonator having stepped inner conductors, in which FIG. 16 is a perspective view, FIG. 17 is a vertical section taken along the line Y1—Y1 of FIG. 16, FIG. 18 is a cross section taken along the line X1—X1 of FIG. 16 and FIG. 19 is a cross section taken along the line X2—X2 of FIG. 16, before fine adjustment, respectively, and FIG. 20 is a vertical section taken along the line Y2—Y2 of FIG. 16, FIG. 21 is a vertical section taken along the line Y1—Y1 of FIG. 16 and FIG. 22 is a cross section taken along the line X1—X1 of FIG. 16, after fine adjustment, respectively. Referring to FIGS. 16 and 17, inner diameter of each of the through holes 2*a* and 2*b* is made different on the side of the first surface (stray surface) S1 and the second surface (short circuited surface) S2. Namely, the inner diameter on the side of the stray surface is larger as shown in FIG. 18, and the inner diameter on the side of the short-circuited surface is smaller as shown in FIG. 19. By providing a step at the inner conductor of the dielectric resonator, the resonators are capacitively coupled.

Further, referring to FIG. 20, when the second non-conducting portion 8*b* is formed continuous with the first non-conducting portion 5*b* at a position opposing to the adjacent through hole, the electrostatic capacitance at portions near the end portions of the inner conductors is reduced, odd mode characteristic impedance is increased, capacitive coupling is reduced and the coupling strength between the resonators is reduced.

Further, referring to FIG. 21, by providing the second non-conducting portions 9*a* and 9*b* continuous with the first non-conducting portions 5*a* and 5*b* at positions near the outer conductor, the electrostatic capacitance between the portions near the end portion of the inner conductors 3*a* and 3*b* and outer conductor 6 is reduced, even mode characteristic impedance is increased, capacitive coupling is enhanced and the coupling strength between the resonator is increased.

In the dielectric resonator having the stepped inner conductor, the second non-conducting portions may be provided both at the position opposing to the adjacent through hole and at the position adjacent to the outer conductor, so as to independently adjust electrostatic capacitances Cij and Ci shown in FIG. 22 and to adjust coupling strength between the resonators as well as the resonance frequency.

Figure 23:
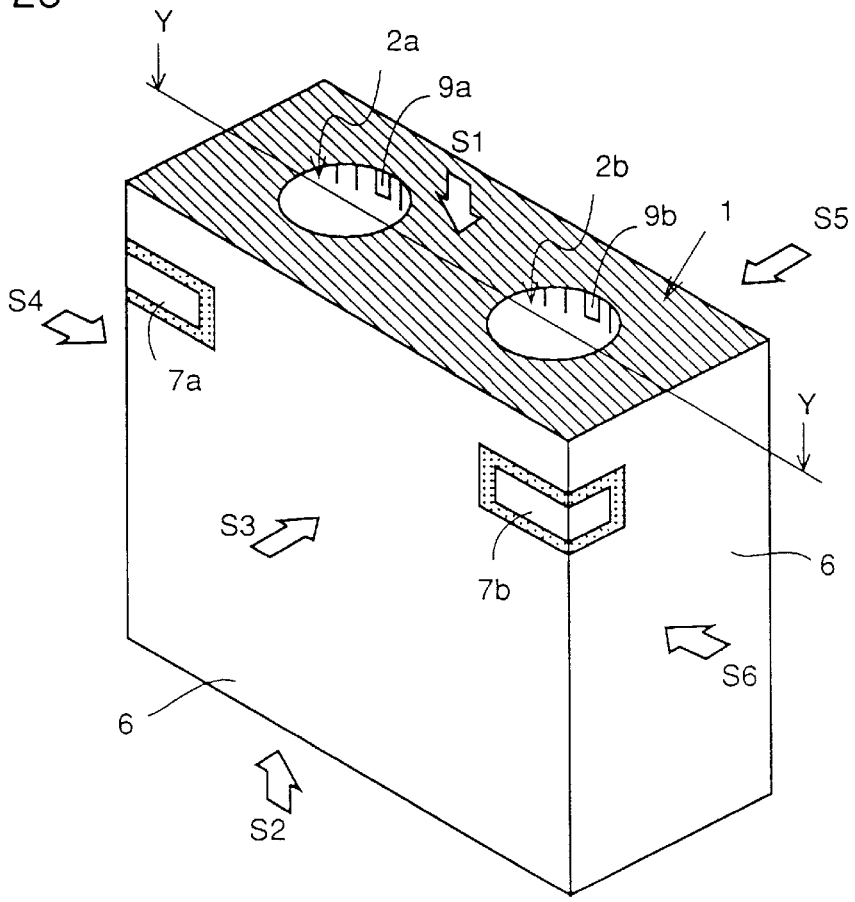
FIG. 23 is a perspective view of the dielectric resonator in accordance with a seventh embodiment of the present invention.
Figure 24:
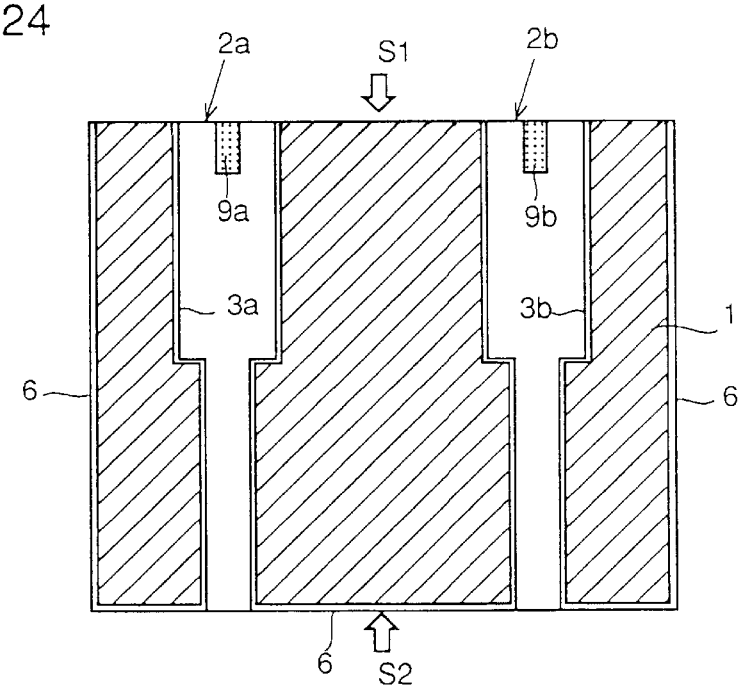
FIG. 24 is a vertical section taken along the line Y—Y of FIG. 23.
Figure 25:
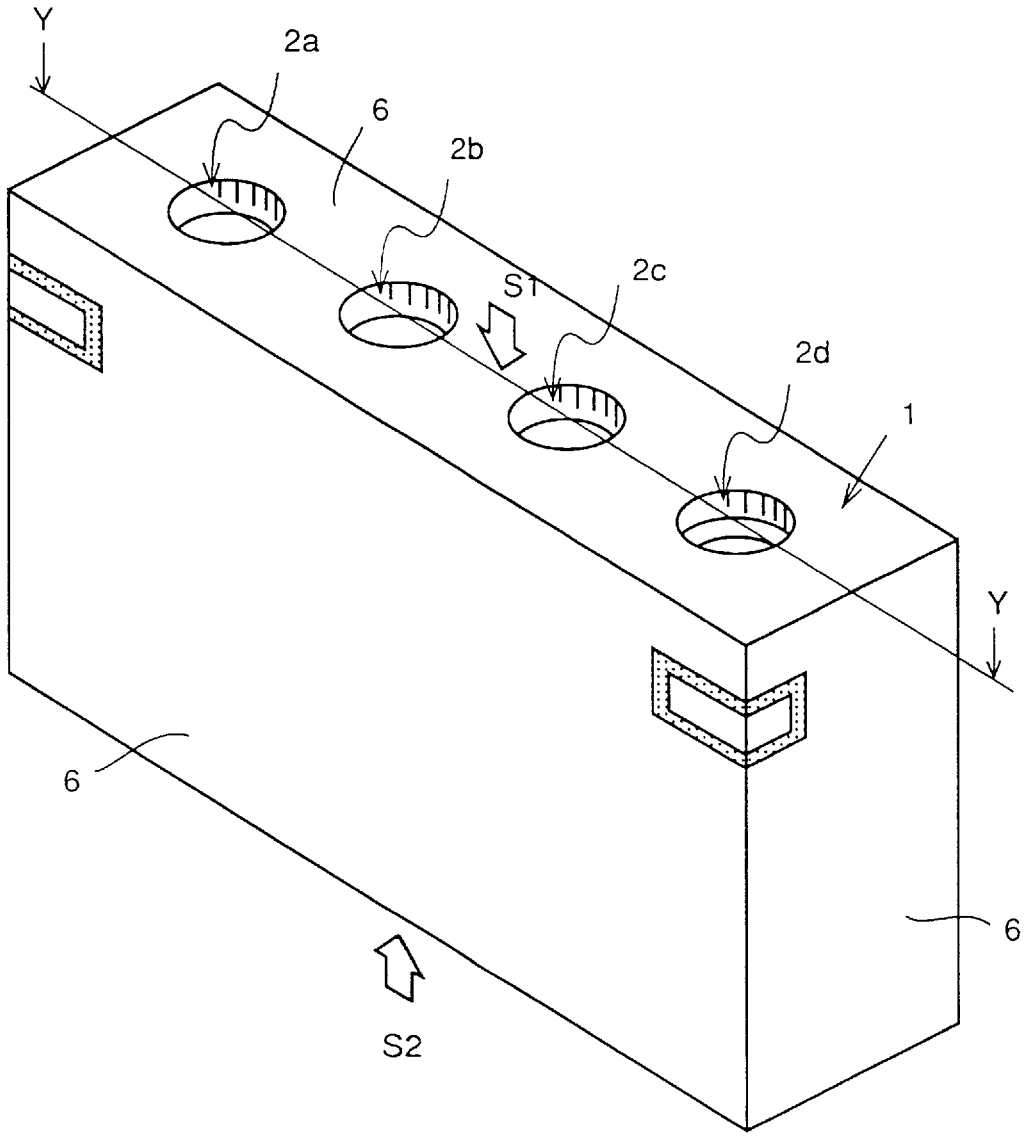
FIG. 25 PRIOR ART
FIG. 25 is a perspective view of a conventional dielectric resonator.
Figure 26:
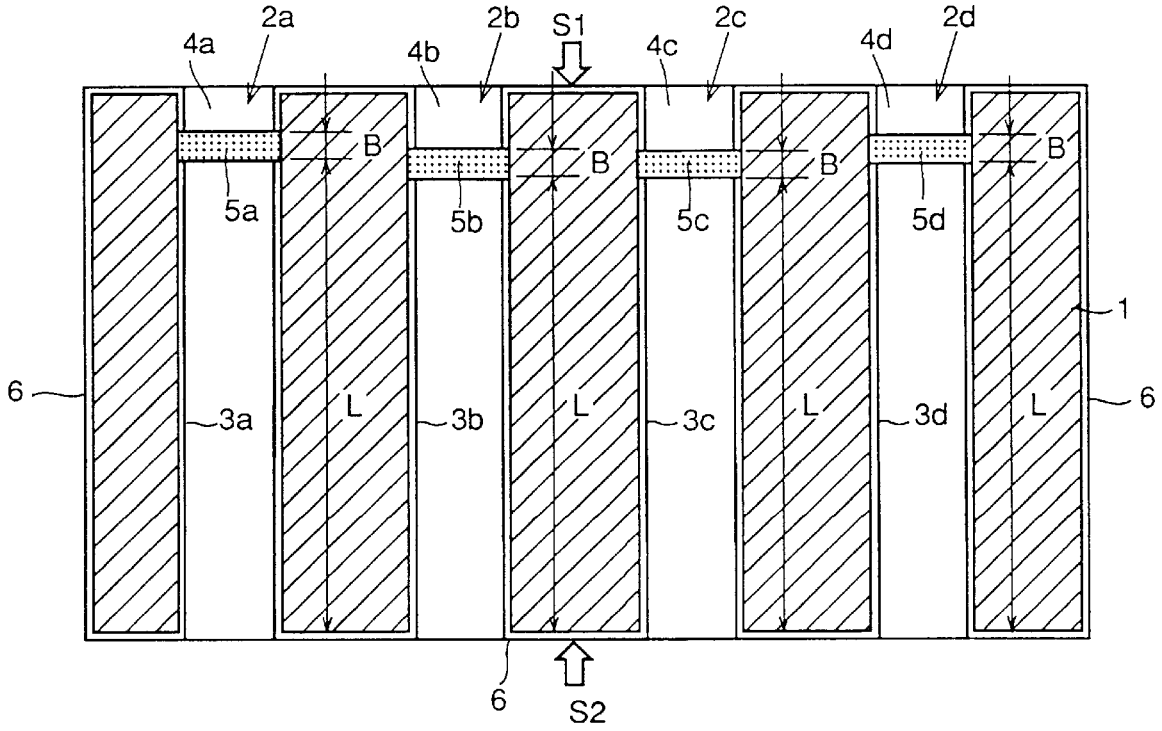
FIG. 26 PRIOR ART
FIG. 26 is a vertical section taken along the line Y—Y of FIG. 25.

FIGS. 23 and 24 show the dielectric resonator in accordance with the seventh embodiment of the present invention, in which FIG. 23 is a perspective view and FIG. 24 is a vertical section taken along the line Y—Y of FIG. 23.

In the examples shown in FIGS. 16 to 22, the outer conductor 6 is formed on the first surface S1 of the dielectric block. In the embodiment shown in FIGS. 23 and 24, the first surface S1 is an open-circuited surface. If the inner conductor has stepped structure, it is possible to adjust the electrostatic capacitance between the inner conductor and the outer conductor 6 by using the first surface S1 of the dielectric block 6 as an open-circuited surface and by providing the second non-conducting portions 9*a* and 9*b* at openings of through holes 2*a* and 2*b*.

Though a λ/4 resonator having a short-circuited surface at one end of the inner conductor has been described in the embodiments above, the present invention can be similarly applied to a λ/2 resonator in which the inner conductor serving as the resonance conductor has both ends open-circuited. Though the inner conductor is provided on the inner surface of the through hole of the dielectric block in each of the embodiments above, the resonator hole in which the inner conductor is provided may not be a through hole.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A dielectric resonator, comprising:

a dielectric block having a pair of opposing end surfaces;

an outer conductor disposed at least on one of said pair of opposing end surfaces and on side surfaces of said dielectric block extending between said end surfaces;

a plurality of resonator holes piercing through at least one of said pair of end surfaces of said dielectric block and defining an axial direction oriented between said opposing end surfaces;

a plurality of inner conductors on respective peripheral surfaces of corresponding said resonator holes, each inner conductor having an open-circuited end at one end thereof, and the other end thereof connected to said outer conductor to serve as a short-circuited end, and serving as a respective resonator; and a first non-conducting portion and at least one second nonconducting portion provided on a corresponding peripheral surface of a respective one of said resonator holes, said first and second non-conducting portions respectively being portions of said corresponding peripheral surface having no inner conductor thereon, said respective second non-conducting portion having a generally elongated shape with a prescribed length, and said shape being oriented in said axial direction of said corresponding resonator hole near the open-circuited end of said corresponding inner conductor.

2. The dielectric resonator according to claim 1, wherein at least one said resonator hole has different respective diameters in proximity to said open-circuited ends and short-circuited ends.

3. The dielectric resonator according to claim 1, comprising no more than a single said respective second non-conducting portion per resonator hole.

4. A dielectric resonator, comprising:

a dielectric block having a pair of opposing end surfaces;

an outer conductor disposed at least on one of said pair of opposing end surfaces and on side surfaces of said dielectric block extending between said end surfaces;

a plurality of resonator holes piercing through at least one of said pair of end surfaces of said dielectric block and defining an axial direction oriented between said opposing end surfaces;

a plurality of inner conductors on respective peripheral surfaces of corresponding said resonator holes, each inner conductor having an open-circuited end at one end thereof, and the other end thereof connected to said outer conductor to serve as a short-circuited end, and serving as a respective resonator; and at least one nonconducting portion provided on a corresponding peripheral surface of a respective one of said resonator holes, said at least one non-conducting portion being a portion of said corresponding peripheral surface having no inner conductor thereon, said at least one non-conducting portion having a generally elongated shape with a prescribed length, and said shape being oriented in said axial direction of said corresponding resonator hole near the open-circuited end of said corresponding inner conductor;

wherein said at least one non-conducting portion is located at a position opposing an adjacent resonator hole and another non-conducting portion is located at a position in proximity to said outer conductor.

5. A dielectric resonator, comprising:

a dielectric block having a pair of opposing end surfaces;

outer conductor disposed at least on one of said pair of opposing end surfaces and on side surfaces of said dielectric block extending between said end surfaces;

a plurality of resonator holes piercing through at least one of said pair of end surfaces of said dielectric block and defining an axial direction oriented between said opposing end surfaces;

a plurality of inner conductors on respective peripheral surfaces of corresponding said resonator holes, each inner conductor having an open-circuited end at one end thereof, and the other end thereof connected to said outer conductor to serve as a short-circuited end, and serving as a respective resonator; and at least one nonconducting portion provided on a corresponding peripheral surface of a respective one of said resonator holes, said at least one non-conducting portion being a portion of said corresponding peripheral surface having no inner conductor thereon, said at least one non-conducting portion having a generally elongated shape with a prescribed length, and said shape being oriented in said axial direction of said corresponding resonator hole near the open-circuited end of said corresponding inner conductor;

wherein said at least one non-conducting portion is located at a position intermediate between a position opposing an adjacent resonator hole and a position in proximity to said outer conductor.

6. A dielectric resonator, comprising:

a dielectric block having a pair of opposing end surfaces;

an outer conductor disposed at least on one of said pair of opposing end surfaces and on side surfaces of said dielectric block extending between said end surfaces;

a plurality of resonator holes piercing through at least one of said pair of end surfaces of said dielectric block and defining an axial direction oriented between said opposing end surfaces;

a plurality of inner conductors on respective peripheral surfaces of corresponding said resonator holes, each inner conductor having an open-circuited end at one end thereof, and the other end thereof connected to said outer conductor to serve as a short-circuited end, and serving as a respective resonator; and at least one nonconducting portion provided on a corresponding peripheral surface of a respective one of said resonator holes, said at least one non-conducting portion being a portion of said corresponding peripheral surface having no inner conductor thereon, said at least one non-conducting portion having a generally elongated shape with a prescribed length, and said shape being oriented in said axial direction of said corresponding resonator hole near the open-circuited end of said corresponding inner conductor;

wherein said at least one non-conducting portion is located at a position in proximity to said outer conductor.

7. A dielectric resonator, comprising:

a dielectric block having a pair of opposing end surfaces;

an outer conductor on said opposing end surfaces and on side surfaces of said dielectric block extending between said end surfaces;

a plurality of resonator holes piercing through at least one of said pair of end surfaces of said dielectric block and defining an axial direction oriented between said opposing end surfaces;

a plurality of inner conductors on respective peripheral surfaces of corresponding said resonator holes, each inner conductor having an open-circuited end at one end thereof, and the other end thereof connected to said outer conductor to serve as a short-circuited end, and serving as a respective resonator; and a ring-shaped first non-conducting portion and at least one second non-conducting portion provided on a corresponding peripheral surface of a respective one of said resonator holes, said first and second non-conducting portions respectively being portions of said corresponding peripheral surface having no inner conductor thereon, said respective second non-conducting portion having a generally elongated shape and extending over a prescribed length in said axial direction of said corresponding resonator hole near the open-circuited end of said corresponding inner conductor;

wherein said respective ring-shaped first non-conducting portion is located at at one of said short-circuited and open-circuited ends of said corresponding inner conductor, for electrically isolating said outer conductor from said respective inner conductor.

8. The dielectric resonator according to claim 7, wherein said respective second non-conducting portion is continuous with the corresponding said first non-conducting portion.

9. The dielectric resonator according to claim 7, wherein said respective first non-conducting portion is at a position in proximity to said outer conductor.

10. The dielectric resonator according to claim 7, comprising no more than a single said respective second non-conducting portion per resonator hole.

11. The dielectric resonator according to claim 7, wherein at least one said second non-conducting portion is substantially rectangular.

12. The dielectric resonator according to claim 11, wherein said respective second non-conducting portion is continuous with the corresponding said first non-conducting portion.

13. A method of manufacturing a dielectric resonator, comprising the steps of:

forming a plurality of resonator holes, each resonator hole having an inner conductor therein serving as a respective resonator, in a dielectric block having a pair of opposing end surfaces, and defining an axial direction oriented between said opposing end surfaces;

forming an outer conductor on at least one of said end surfaces and on side surfaces of said dielectric block extending between said end surfaces; and removing a portion of at least one of said plurality of inner conductors by a prescribed length in a shape elongated along said axial direction and near an open end of the corresponding said resonator hole, for finely adjusting resonance frequency and simultaneously adjusting coupling strength between said resonators substantially independently of said resonance frequency;

wherein said step of removing a portion of at least one of said plurality of inner conductors is performed at a position opposing an adjacent said resonator hole for finely adjusting resonance frequency of the dielectric resonator, and finely adjusting electrostatic capacitance, between the position at which said portion of said at least one inner conductor is removed and the inner conductor provided in the adjacent resonator hole.

14. A dielectric resonator, comprising:

a dielectric block having a pair of opposing end surfaces;

an outer conductor disposed at least on one of said pair of opposing end surfaces and on side surfaces of said dielectric block extending between said end surfaces;

a plurality of resonator holes piercing through at least one of said pair of end surfaces of said dielectric block and defining an axial direction oriented between said opposing end surfaces;

a plurality of inner conductors on respective peripheral surfaces of corresponding said resonator holes, each inner conductor having an open-circuited end at one end thereof, and the other end thereof connected to said outer conductor to serve as a short-circuited end, and serving as a respective resonator; and at least one nonconducting portion provided on a corresponding peripheral surface of a respective one of said resonator holes, said at least one non-conducting portion being a portion of said corresponding peripheral surface having no inner conductor thereon, said at least one non-conducting portion having a generally elongated shape with a prescribed length, and said shape being oriented in said axial direction of said corresponding resonator hole near the open-circuited end of said corresponding inner conductor;

wherein said at least one non-conducting portion is located at a position opposing an adjacent resonator hole.

15. A method of manufacturing a dielectric resonator, comprising the steps of:

forming a plurality of resonator holes, each resonator hole having an inner conductor therein serving as a respective resonator, in a dielectric block having a pair of opposing end surfaces, and defining an axial direction oriented between said opposing end surfaces;

forming an outer conductor on at least one of said end surfaces and on side surfaces of said dielectric block extending between said end surfaces; and removing a portion of at least one of said plurality of inner conductors by a prescribed length in a shape elongated along said axial direction and near an open end of the corresponding said resonator hole, for finely adjusting resonance frequency and simultaneously adjusting coupling strength between said resonators substantially independently of said resonance frequency; wherein said step of removing a portion of at least one of said plurality of inner conductors is performed at a position opposing an adjacent said resonator hole and at a position near said outer conductor, for finely adjusting resonance frequency of the dielectric resonator, and for finely adjusting electrostatic capacitance, between the position where said portion of said at least one inner conductor is removed, and the inner conductor provided in the adjacent resonator hole, and between the position where said portion of said at least one inner conductor is removed and the outer conductor.

16. A method of manufacturing a dielectric resonator, comprising the steps of:

forming a plurality of resonator holes, each resonator hole having an inner conductor therein serving as a respective resonator, in a dielectric block having a pair of opposing end surfaces, and defining an axial direction oriented between said opposing end surfaces;

forming an outer conductor on at least one of said end surfaces and on side surfaces of said dielectric block extending between said end surfaces; and removing a portion of at least one of said plurality of inner conductors by a prescribed length in a shape elongated along said axial direction and near an open end of the corresponding said resonator hole, for finely adjusting resonance frequency and simultaneously adjusting coupling strength between said resonators substantially independently of said resonance frequency; wherein said step of removing a portion of at least one of said plurality of inner conductors is performed at a position intermediate between a position opposing an adjacent resonator hole and a position near said outer conductor, for finely adjusting resonance frequency of the dielectric resonator, and for finely adjusting electrostatic capacitance, between the position where said portion of said at least one inner conductor is removed, and the inner conductor provided in the adjacent resonator hole, and between the position where said portion of said at least one inner conductor is removed and the outer conductor.

17. A method of manufacturing a dielectric resonator, comprising the steps of:

forming a plurality of resonator holes, each resonator hole having an inner conductor therein serving as a respective resonator, in a dielectric block having a pair of opposing end surfaces, and defining an axial direction oriented between said opposing end surfaces;

forming an outer conductor on at least one of said end surfaces and on side surfaces of said dielectric block extending between said end surfaces; and removing a portion of at least one of said plurality of inner conductors to form a first non-conducting portion and at least one second non-conducting portion, said second non-conducting portion having a prescribed length in a shape elongated along said axial direction and near an open end of the corresponding said resonator hole, for finely adjusting resonance frequency and simultaneously adjusting coupling strength between said resonators substantially independently of said resonance frequency.

18. The dielectric resonator according to claim 17, wherein there is no more than a single said respective second portion removed per resonator hole.

19. The method of manufacturing a dielectric resonator according to claim 17, wherein said step of removing a portion of at least one of said plurality of inner conductors is performed at a position near said outer conductor, for finely adjusting resonance frequency of the dielectric resonator and finely adjusting electrostatic capacitance, between the position where said portion of said at least one inner conductor is removed and said outer conductor.

20. A dielectric resonator, comprising:

a dielectric block having a pair of opposing end surfaces;

an outer conductor disposed at least on one of said pair of opposing end surfaces and on side surfaces of said dielectric block extending between said end surfaces;

a plurality of resonator holes piercing through at least one of said pair of end surfaces of said dielectric block and defining an axial direction oriented between said opposing end surfaces;

a plurality of inner conductors on respective peripheral surfaces of corresponding said resonator holes, each inner conductor having an open-circuited end at one end thereof, and the other end thereof connected to said outer conductor to serve as a short-circuited end, and serving as a respective resonator; and at least one nonconducting portion provided on a corresponding peripheral surface of a respective one of said resonator holes, said at least one non-conducting portion being a portion of said corresponding peripheral surface having no inner conductor thereon, said at least one non-conducting portion having a generally elongated shape with a prescribed length, and said shape being oriented in said axial direction of said corresponding resonator hole near the open-circuited end of said corresponding inner conductor;

wherein said at least one non-conducting portion is substantially rectangular.

21. The dielectric resonator according to claim 20, wherein at least one said resonator hole has different respective diameters in proximity to said open-circuited ends and short-circuited ends.

22. A dielectric resonator, comprising:

a dielectric block having a pair of opposing end surfaces;

an outer conductor on said opposing end surfaces and on side surfaces of said dielectric block extending between said end surfaces;

a plurality of resonator holes piercing through at least one of said pair of end surfaces of said dielectric block and defining an axial direction oriented between said opposing end surfaces;

a plurality of inner conductors on respective peripheral surfaces of corresponding said resonator holes, each inner conductor having an open-circuited end at one end thereof, and the other end thereof connected to said outer conductor to serve as a short-circuited end, and serving as a respective resonator; and a ring-shaped first non-conducting portion and at least one second non-conducting portion provided on a corresponding peripheral surface of a respective one of said resonator holes, said first and second non-conducting portions respectively being portions of said corresponding peripheral surface having no inner conductor thereon, said respective second non-conducting portion having a generally elongated shape and extending over a prescribed length in said axial direction of said corresponding resonator hole near the open-circuited end of said corresponding inner conductor;

wherein said respective ring-shaped first non-conducting portion is spaced away from both said end surfaces of said dielectric block, for electrically isolating said outer conductor from said respective inner conductor.

23. The dielectric resonator according to claim 22, wherein said respective second non-conducting portion is substantially rectangular and continuous with the corresponding said first non-conducting portion.

24. The dielectric resonator according to claim 23, wherein said respective second non-conducting portion is at a position opposing an adjacent resonator hole.

25. The dielectric resonator according to claim 23, wherein said respective second non-conducting portion is at a position in proximity to said outer conductor.

26. The dielectric resonator according to claim 23, wherein said respective second non-conducting portion is at a position opposing an adjacent resonator hole and another said second non-conducting portion is respectively at a position in proximity to said outer conductor.

27. The dielectric resonator according to claim 23, wherein said respective second non-conducting portion is at a position intermediate between a position opposing an adjacent resonator hole and a position in proximity to said outer conductor.

28. The dielectric resonator according to claim 23, wherein at least one said resonator hole has different respective diameters in proximity to said open-circuited ends and short-circuited ends.

29. The dielectric resonator according to claim 22, wherein said respective second non-conducting portion is substantially rectangular and is independent of the corresponding said first non-conducting portion.

30. The dielectric resonator according to claim 29, wherein said respective second non-conducting portion is at a position selected from the group consisting of a position in proximity to said outer conductor, a position opposing an adjacent resonator hole, and an intermediate position between said position in proximity to said outer conductor and said position opposing an adjacent resonator hole.

31. The dielectric resonator according to claim 22, wherein said respective second non-conducting portion is rounded in shape and is independent of the corresponding said first non-conducting portion.

32. The dielectric resonator according to claim 31, wherein said respective second non-conducting portion is at a position selected from the group consisting of a position in proximity to said outer conductor, a position opposing an adjacent resonator hole, and an intermediate position between said position in proximity to said outer conductor and said position opposing an adjacent resonator hole.

33. The dielectric resonator according to claim 22, wherein said respective second non-conducting portion is rounded in shape and is continuous with the corresponding said first non-conducting portion.

34. The dielectric resonator according to claim 33, wherein said respective second non-conducting portion is at a position selected from the group consisting of a position in proximity to said outer conductor, a position opposing an adjacent resonator hole, and an intermediate position between said position in proximity to said outer conductor and said position opposing an adjacent resonator hole.

35. The dielectric resonator according to claim 22, comprising no more than a single said respective second non-conducting portion per resonator hole.

* * * * *